US007455368B2

(12) United States Patent
Kussel et al.

(10) Patent No.: US 7,455,368 B2
(45) Date of Patent: Nov. 25, 2008

(54) CONTROL MECHANISM FOR THE EXTENSION UNITS IN THE LONGWALL FACE OF A MINE

(75) Inventors: Willi Kussel, Werne (DE); Peter Rahms, Billabeck (DE)

(73) Assignee: Tiefenbach Control Systems GmbH, Essen (DE)

( * ) Notice: Subject to any disclaimer, the term of this patent is extended or adjusted under 35 U.S.C. 154(b) by 0 days.

(21) Appl. No.: 10/538,828

(22) PCT Filed: Dec. 11, 2003

(86) PCT No.: PCT/DE03/04083

§ 371 (c)(1),
(2), (4) Date: Feb. 2, 2006

(87) PCT Pub. No.: WO2004/059129

PCT Pub. Date: Jul. 15, 2004

(65) Prior Publication Data

US 2006/0158016 A1 Jul. 20, 2006

(30) Foreign Application Priority Data

Dec. 21, 2002 (DE) ..... 102 61 139

(51) Int. Cl.
*E21D 23/12* (2006.01)
*E21D 23/14* (2006.01)
*E21D 23/00* (2006.01)
*E21C 35/24* (2006.01)

(52) U.S. Cl. ..... 299/1.7; 405/302

(58) Field of Classification Search ..... 299/1.05, 299/1.3, 1.6, 1.7; 405/302
See application file for complete search history.

(56) References Cited

U.S. PATENT DOCUMENTS

| | | | | | |
|---|---|---|---|---|---|
| 3,406,342 | A | * | 10/1968 | Hubner | 340/503 |
| 4,146,271 | A | * | 3/1979 | Ward et al. | 299/1.7 |
| 5,029,943 | A | * | 7/1991 | Merriman | 299/1.7 |
| 6,481,802 | B1 | * | 11/2002 | Kussel | 299/1.6 |
| 6,509,842 | B1 | * | 1/2003 | Kussel | 340/870.28 |

FOREIGN PATENT DOCUMENTS

| | | | | |
|---|---|---|---|---|
| DE | 195 46 427 | A1 | | 8/1996 |
| DE | 10207698 | A1 | * | 10/2002 |
| DE | 199 82 113 | C1 | | 12/2003 |
| GB | 2 167 924 | A | | 6/1986 |
| GB | 2167924 | | * | 6/1986 |
| GB | 2265652 | | * | 10/1993 |
| GB | 2265652 | A | * | 10/1993 |

* cited by examiner

*Primary Examiner*—Sunil Singh
(74) *Attorney, Agent, or Firm*—Alston & Bird LLP

(57) ABSTRACT

A longwall support control for controlling the movements of the longwall support units and the advance heading in the longwall of a mine comprises a plurality of control units, of which a separate mining shield control device is locally and operationally associated to each longwall support unit. Each mining shield control device comprises a multi-channel radio transceiver, such that the mining shield control device is in a simultaneous transmit and receive mode with a decentralized operating device for receiving control signals and for transmitting inspection data. The mining shield control devices may be interconnected and each mining shield control device may include an amplifier.

5 Claims, 3 Drawing Sheets

CONTROL MECHANISM FOR THE EXTENSION UNITS IN THE LONGWALL FACE OF A MINE

BACKGROUND

The invention relates to a longwall support control for controlling the movements of the longwall support units in the longwall of a mine.

A control system of this type is disclosed in DE 102 07 698.7 A1 as well as in DE 199 82 113.5-24 A1 (U.S. Pat. No. 6,481,802).

This longwall support control permits activating the individual longwall support control units, in the present application also referred to as mining shields, from a central control or by individual control units, which are each associated to a mining shield (mining shield control devices) or via radio by an operating device. Basically, the radio commands that are input by the operating device are transmitted to one of the mining shield control devices, which is provided with a receiving set. From this mining shield control device, respectively adjacent or a plurality of adjacent shields are activated. Basically, the control signals are transmitted to all mining shield control devices via a line that is common to all mining shield control devices. However, the mining shield control devices are programmed such that only that mining shield control device is addressed and caused to execute the control commands, to which the code word is associated that is transmitted along with the control command. All other mining shield control devices retransmit the control signal with the code word. With an input of a control command the common line (bus line) is taken.

It is an object of the invention to improve the longwall support control, which permits transmitting signals at the same time between the operating device and the mining shield control devices in both directions, and which permits transmitting in particular also other signals along with a control signal.

BRIEF SUMMARY OF THE PRESENT INVENTION

The present invention achieves the above and other objects by providing a longwall support control for controlling the movements of the longwall support units and the advance heading in the longwall of a mine, comprising a central control system, and a plurality of control units, of which a separate mining shield control device is locally and operationally associated to each longwall support unit, the mining shield control devices being connected via radio to a decentralized operating device for inputting control commands and for feeding back inspection data, wherein each mining shield control device comprises a multi-channel radio transceiver, such that the mining shield control device is in a simultaneous transmit and receive mode with the decentralized operating device for receiving control signals and for transmitting inspection data, and wherein the mining shield control device is programmed in such a manner that control signals that are received via radio, can be converted into functions of the longwall support unit when the control signal stores a code word that is associated with the called up mining shield control device.

This improvement brings along the advantage that the entire mining control, including the control of the mining shields and the mining machines occur from an operating device, preferably a hand-operated device, and that it permits performing a completion check at the same time by verifying retransmitted data of state and measuring data. In particular, when starting up a system, it will be possible to call up, one after the other, all mining shield control devices individually for monitoring their state or for a test operation, and the operator is able to follow the working of the coal face and the control movements of the longwall support devices, and to pursue the correctness of the longwall support. Until now, this has not been possible for lack of feedback. On the other hand, the invention does without the presence of the operator on site, and in particular in the hazardous region of the moved mining shields and mining machines.

In another embodiment of the present invention, the mining shield control devices are interconnected and also connected to a central control system via at least one bus line for transferring input data to all mining shield control devices. With this embodiment, it is achieved in addition that the distance between the operating device and the mining shield control device, which must be bridged by means of radio, is always only short and easy to survey, whereas the data transfer to farther removed mining shield control devices occurs via a cable and therefore is insensitive to interference. On the other hand, the multichannel operation of the present invention causes that with each control signal, the state of the addressed control unit is checked at the same time, so that interferences in the radio communication or cable transmission are noticed immediately, thereby taking into account the safety requirements of mining.

In another embodiment, the mining shield control devices are interconnected and also connected to the central control system by a parallel bus line. This arrangement adapts the density of data that can be transmitted via cable to the data density of the radio communication.

Because of the length of the longwall, there is a risk that the signals that are transmitted via cable (bus line) from mining shield control device to mining shield control device are greatly attenuated, so that they can no longer be received or correctly interpreted by far removed mining shield control devices and in particular by the central control system.

This problem is avoided for both bus lines and all transmitted signals respectively by including in each mining shield control device, an amplifier for the signals that are received via at least one of the bus lines, and which are not associated to the mining shield control device by their code word.

Irrespective of the input control signals, the invention also permits transmitting measuring signals or other signals of state to the operator or the central control system. It likewise permits transmitting in the case of each control signal at the same time and without time delay a signal of acknowledgment, which acknowledges the receipt and/or execution of the control command.

BRIEF DESCRIPTION OF THE DRAWINGS

Reference will now be made to the accompanying drawings, wherein.

DETAILED DESCRIPTION OF THE INVENTION

Figure 1:
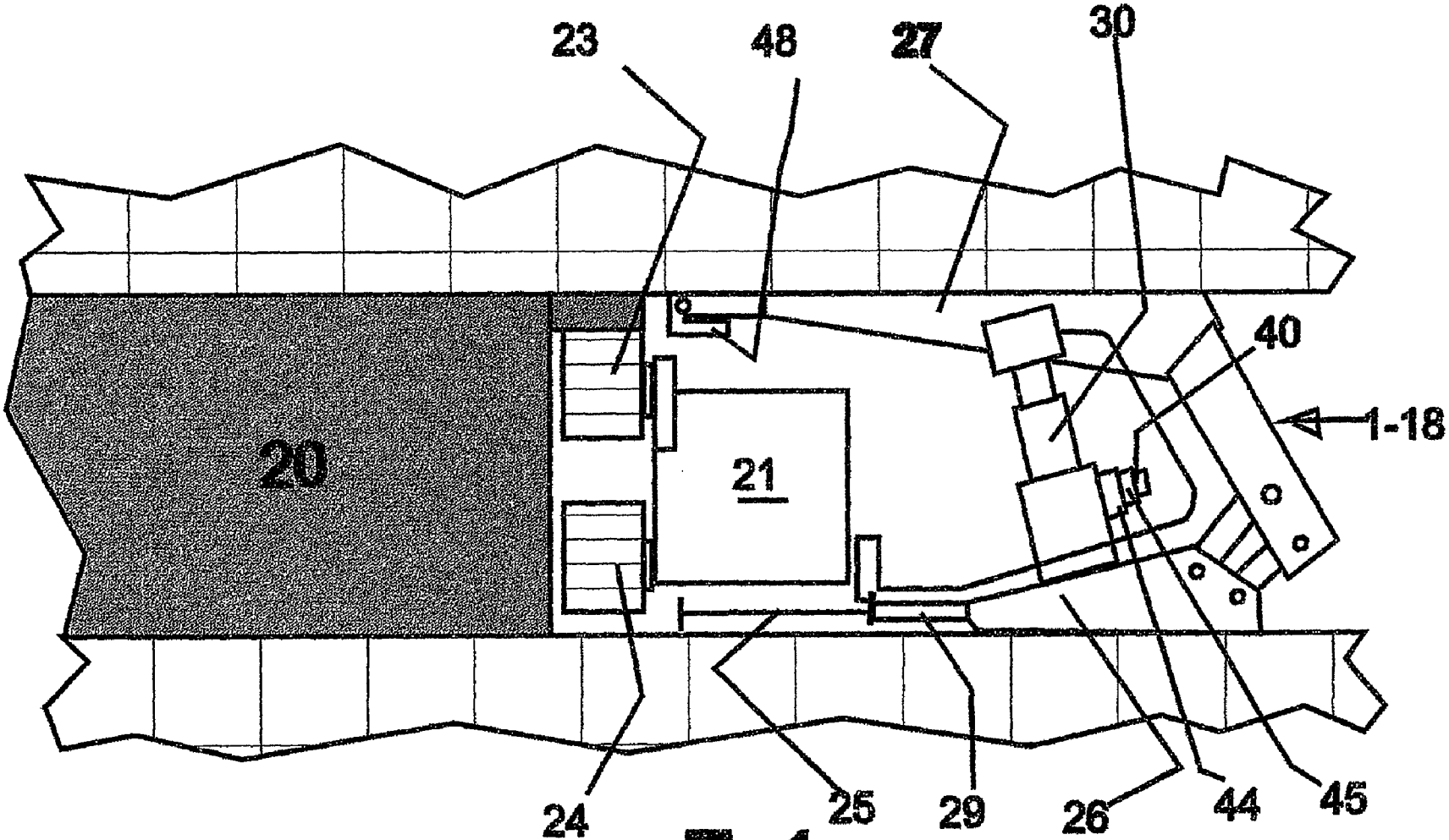
FIG. 1 is a sectional view of a longwall face with a longwall support.
Figure 2:
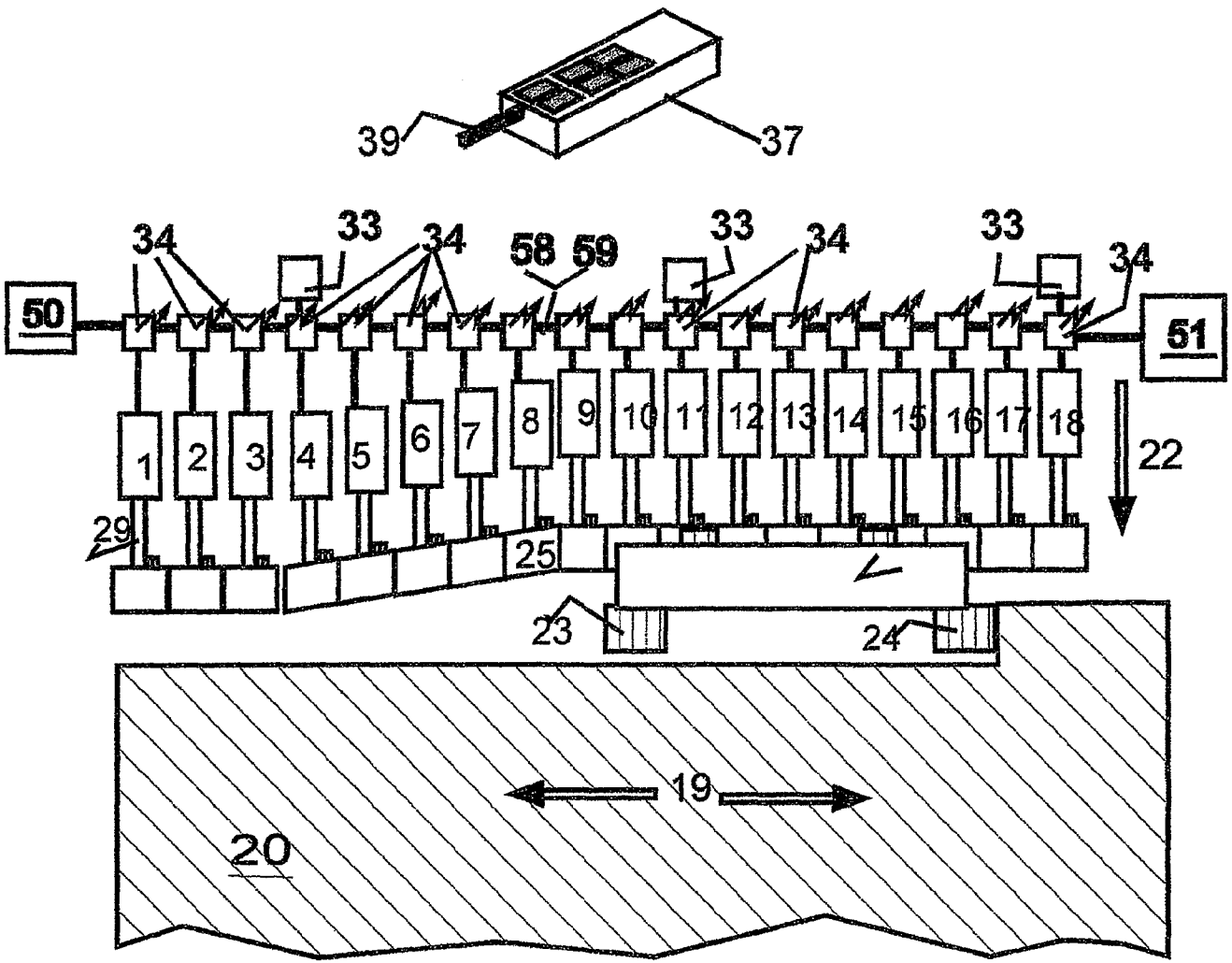
FIG. 2 is a schematic plan view of a coal cutting machine and a group of longwall supports.

FIG. 1 illustrates one of longwall support units 1-18. FIG. 2 illustrates a plurality of longwall support units 1-18. The support units are arranged along a coal bed 20. The coal bed 20 is mined in a working direction 22 with a cutting device 23, 24 of an extraction machine 21. In the illustrated embodiment, the extraction machine is a coal cutting machine 21.

The coal cutting machine 21 is movable in a cutting direction 19 by means of a cable not shown. It possesses two cutting rolls 23, 24 that are adjusted to different heights, and that shear the coal face. The dislodged coal is loaded by the coal cutting machine, also named "cutter-loader," on a conveyor. The conveyor consists of a channel 25, in which an armored chain conveyor is moved along the coal face. The coal cutting machine 21 is adapted for moving along the coal face. The channel 25 is subdivided into individual units, which are interconnected, though, but are capable of performing a movement relative to one another in the working direction 22. Each of the units connects to one of the longwall support units 1-18 by means of a cylinder-piston unit (advance piston) 29, which is used a biasing means. Each of the longwall support units serves the purpose of supporting the longwall. To this end, a further cylinder-piston unit 30 is used, which stays a base plate relative to a roof plate. At its front end facing the coal bed, the roof plate mounts a so-called coal face catcher 48. This catcher is a flap that can be lowered in front of the mined coal face. The coal face catcher must be raised ahead of the approaching coal cutting machine 21. Likewise to this end, a further cylinder-piston unit not shown is used. These operating elements of the individual longwall support are shown only by way of example. While additional operating elements are present, they need not be mentioned and described for the understanding of the invention.

As aforesaid, each of the biasing means is a hydraulic cylinder-piston unit.

These cylinder-piston units are actuated via valves 44 and pilot valves 45. The pilot valve mounts a valve control device 40, i.e., a housing that accommodates the valve control.

In FIG. 2, the coal cutting machine moves to the right. For this reason, it is necessary that the coal face catcher of the longwall support unit 17 be folded back. On the other hand, the unit of channel 25 on the longwall support unit 9, which is located—in the direction of movement 19—behind the coal cutting machine 21, is advanced in direction toward the mined coal face. Likewise, the following longwall support units 8, 7, 6, 5, and 4 are in the process of advancing in the direction toward the longwall or the mined coal face. The coal face catcher on these longwall support units has already been lowered again. The support units 3, 2, 1 have finished their approach and remain in this position, until the coal cutting machine approaches again from the right.

As a function of the movements and the instantaneous position of the coal cutting machine, the control of these movements occurs in part automatically, in part by hand. To this end, a separate mining shield control device 34 is associated to each of the longwall supports 1-18. Each of the mining shield control devices 34 is associated to one of the longwall supports 1-18 and separately connected to the pilot valves 45 and main valves 44 of all biasing means of the longwall support units 1-18 via a valve control device (microprocessor) 40.

Each of the mining shield control devices may be used for inputting and retrieving data. However, a group of a plurality of mining shield control devices can be superposed by a longwall control device 33, or also the entirety of the mining shield control devices can be superposed by a central longwall support control system (primary central control system 50 and/or secondary central control system 51) for inputting the data, which connects to the mining shield control devices. Such an arrangement is shown in FIG. 2.

The central longwall support control system consists of the primary central control system 50 and secondary central control system 51.

A cable 58 (bus line) interconnects all mining shield control devices 34. Each of the mining shield control devices retransmits the input or output operating commands, and inspection data, such as data of state and other data. The operating command triggers in a certain mining shield a certain operating function, for example, in the sense of robbing, advancing, and setting. This mining shield operating command is received and retransmitted by all mining shield control devices 34 via the bus line 58. These mining shield operating/control commands may be triggered by hand on the primary central control system 50 or secondary central control system 51, longwall control device 33, which is assigned to respectively one group of mining shield control devices, or via an operating device 37. The input mining shield operating commands are transmitted respectively from the primary central control system 50 and secondary central control system 51, longwall control device 33, and operating device 37 to the nearest mining shield control device. From this mining shield control device, the operating commands then reach all other mining shield control devices 34 via the bus line 58. However, by a predetermined coding, only one of the longwall support units 1-18 or a group thereof is activated for carrying out the respective shield functions. The activated mining shield control device then converts the received operating command into valve control commands to the control valves or main valves that are associated to the particular mining shields.

The automatic release of the functions and operating sequences is disclosed, for example, in DE-A1 195 46 427.3.

At the same time, the addressed mining shield control device is caused to output the data of state of the addressed operational elements, such as, for example, the cylinder-piston units, and other measuring data. This inspection data is then again retransmitted via the bus line 58, and retransmitted by the respectively adjacent mining shield control device to at least the command-releasing device, i.e., the primary central control system 50, or the secondary central control system 51, or the longwall control device 33, or the operating device 37. With that, the operator, who inputs an operating command, is able to verify immediately whether or not the intended function has been released.

In the same manner, it is possible to input inquiry commands and to transmit them by coding to certain mining shield control devices. This permits performing from a central location a monitoring of the state of all command controls and mining shields. In this instance, no interferences are to be expected because of the spatially short distance of the radio contact. As aforesaid, a control device 37 which is constructed as a hand-operated device and carried along by the operator, is used for manually performing the command input. To input the commands, the operator can be in a location away from the longwall, or be at least removed from the instant mining location.

The hand-operated device connects by means of radio to radio receivers 38, which are provided in each of the mining shield control devices. The mining shield control device that is closest to the operating device receives the strongest radio signals. Accordingly, this mining shield control device then retransmits the received signal via the bus line 58, so that the mining shield control device that has been addressed by the code word, is able to respond accordingly. However, at the same time, an acknowledgment signal of the addressed mining shield control device is also transmitted to the individual radio transceivers via one of the channels of the radio communication, and preferably also a signal reflecting the state and change of state via the bus line 58, so that the strongest radio signal that is expected to come from the closest mining shield control device, is simultaneously transmitted to the operating device. With that, the operator has the possibility of a direct completion check.

As a result of the multi-channel radio contact of the hand-operated device via respectively one of the mining shield control devices with all mining shield control devices, as well as primary, secondary, and longwall control devices, the operating device is able to receive at the same time the entire data traffic, so that contradicting control commands are avoided.

The hand-operated device may have the shape of a rectangular block and comprises operating keys on its one side (control side). With these keys, it is possible to input also the code of each longwall support control (one of the mining shield control devices 34.1, 34.2 . . . ) that is to be operated, and an operating command to release a desired function or a desired operational sequence (for example, robbing or advancing). For a radio transmission, for example, an antenna 39 of the hand-operated device is used.

When the operator rotates the hand-operated device about its longitudinal axis by 180°, he will see the control side of the device. This side comprises two diodes, a display, as well as additional keys. With his head lamp, the operator is able to illuminate the two diodes. Only when he covers in this process the one of the diodes, for example, with a finger, will the checking function of the hand-operated device be started. For an inspection, the operator inputs the code of the longwall support that is to be inspected. As a result, the hand-operated device connects by means of radio to the closest mining shield control device, as has previously been described in connection with transmitting control signals. With that a connection is established via radio and via cables 58, 59 to the mining shield control device that is addressed by the code word. The present invention thus enables a direct dialog. By means of one of the keys, the operator is able to recall certain functions or operating conditions. To this-end, the mining shield control device stores a program, which permits directing inquiries or sequences of inquiries concerning functions, operating conditions, and operating functions of a particular mining shield (longwall support unit). Subsequently, the obtained data are transmitted substantially simultaneously via cables 58, 59 to the adjacent mining shield control devices, and from one of the mining shield control devices, via radio, to the hand-operated device, and shown on the display. In this manner, the operator is able to convince himself, whether a certain longwall support unit is still fully operable, or whether it requires maintenance or replacement of operating elements or control elements.

It is thus possible to simulate a test operation. The test operation may also be performed in reality, in that the operator addresses from his location, via the control side of the hand-operated device, each mining shield control device in sequence, and causes it to perform one or more operations. As a result of simultaneously retransmitting the states and the changes in state, it is possible to verify whether the longwall support unit is ready for operation and can be started up.

This enables a reliable, trouble-free, and robust operation of the coal cutting machine and the longwall support, which requires little operating expenditure.

As aforesaid, the mining shield control devices 34 are interconnected by means of the cable 58, which has in the designs of the art only two conductors, and serves for serially transmitting respectively a code word and the mining shield operating command. Only that of the mining shield control devices 34 (longwall support units) is addressed, whose stored code word is identical with the transmitted code word. Thus, the cable 58 is a two-conductor cable, which extends in the form of a bus line from one mining shield control device 34 to the next, and also interconnects the primary central control system 50 and the secondary central control system 51 via the intermediate mining shield control devices 34.

The present invention uses in the place of the previous single two-conductor cable 58, parallel thereto a second two-conductor cable 59, in the present application, also named parallel bus. In the present application, the cables 58, 59 are also called bus lines.

Figure 3:
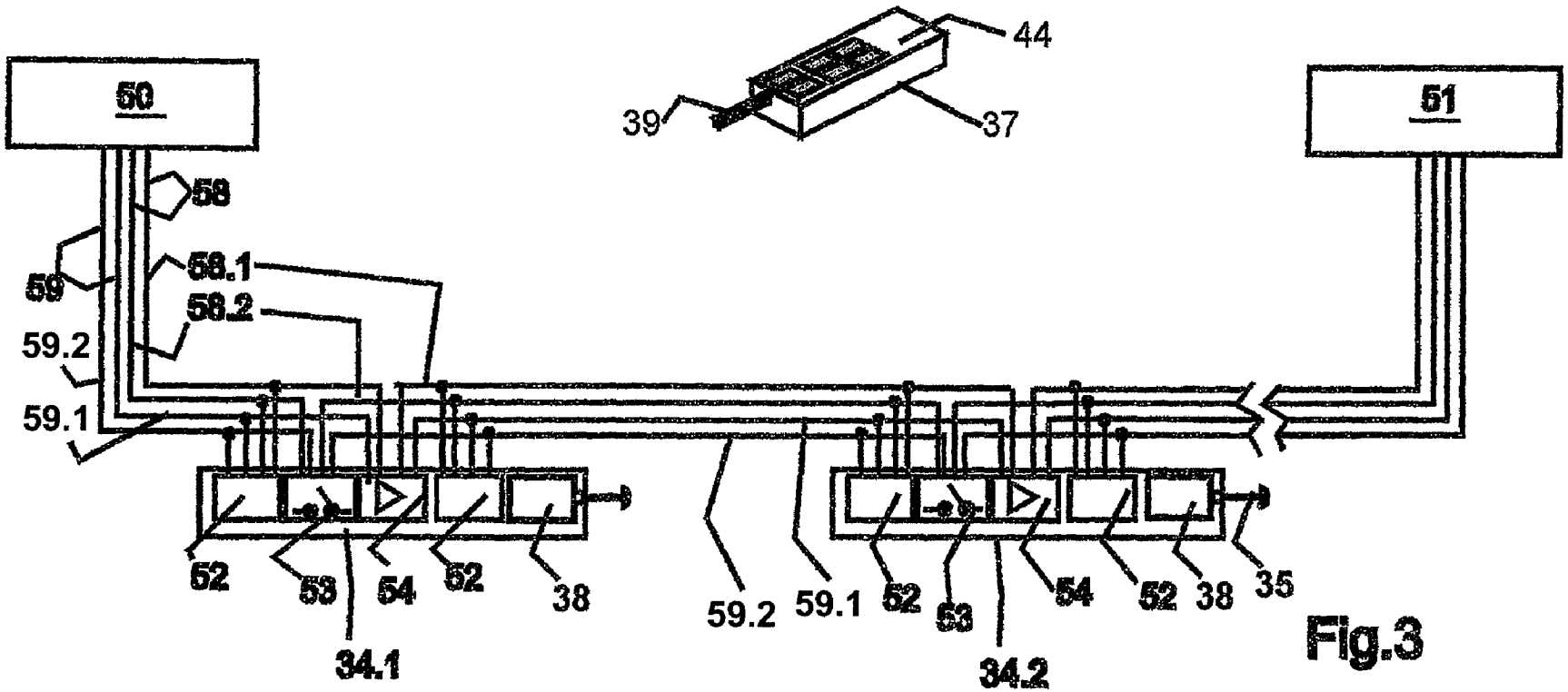
FIG. 3 illustrates a schematic arrangement of a central control system and operating device for the mining shield control devices.

The wiring principle of the cables in the individual mining shield control devices 34 is shown in FIG. 3. Illustrated are two mining shield control devices 34.1 and 34.2 of a plurality of mining shield control devices. The mining shield control devices connect via the bus lines 58 and 59 to the primary central control system 50 and secondary central control system 51. The bus line 58 has two phase conductors 58.1 and 58.2; the bus line 59 has two phase conductors 59.1 and 59.2.

All four phase conductors of the two bus lines connect to input elements 52 of the mining shield control devices 34.1, 34.2 . . . . From the input elements, the incoming signals are processed in the mining shield control devices, i.e., they are first checked to the extent whether the transmitted code word corresponds to the stored code word associated to this particular mining shield control device. Provided the signals being transmitted are control signals, they are then processed and retransmitted to the corresponding operational elements of the shield, which have been previously described.

Each of the phase conductors 58.2 and 59.2 of each of the bus lines is then supplied to a switching element 53. The corresponding phase conductors leave the switching element 53 via its output and subsequently enter the corresponding switching element 53 of the adjacent mining shield control device 34.2. In the switching element 53, the two phase conductors 58.2 and 59.2 can be separated synchronously or individually.

The other phase conductors 58.1 and 59.1 of the bus lines 58 and 59 are then supplied to an amplification element 54. From the output of the amplification element, the corresponding phase conductors are each supplied to the amplification element of the adjacent mining shield control device 34.2 . . . Each mining shield control device 34.1, 34.2 . . . has a further "right-hand" input element 52, which receives and processes the signals that come in from the right side, i.e., the secondary central control system 51, or a mining shield control device 34.3 . . . located further to the right. Adjacent mining shield control devices 34.1, 34.2 are thus again connected by two cables, which each have two phase conductors.

The switch 53 with its two switching elements is normally closed, so that a through-connection occurs. However, a separation of the bus lines will proceed upon occurrence of failures. This will facilitate trouble shooting on the one hand. To this end, one of the control devices (primary and secondary central control systems, hand-operated input device, longwall control device, or mining shield control device) will open the switching elements of the mining shield control devices on the right or left, individually and serially. Thereafter, a control signal will be input. Since the addressed mining shield control devices immediately acknowledge the control signal, it will then be possible to determine, which of the mining shield control devices are located beyond the faulty mining shield control device. On the other hand, the separation can proceed in the case of failure for purposes of isolating a faulty mining shield control device and separate it from the bus line or lines. As a result, the remaining mining shield control devices will remain activatable, and the failure can be eliminated without shutting down the longwall.

In the amplification element 54, the incoming digital signals are refreshed. This occurs by determining in the amplification element, whether the incoming signals exceed a certain predetermined threshold value. If this is the case, signals of greater strength, preferably of the original strength, will be generated in the output, so that transmission of the signal through all mining shield control devices is ensured. This type of amplification presents itself in particular, since control signals, measuring signals, etc. are transmitted in digital form.

As a result, a reliable, trouble-free radio transmission of the required position and direction signals as well as the inspection data is also possible in underground mining. The longwall support control can be reliably controlled by means of radio also in the case of a significant length of the longwall. To this end, the control device has the characteristic that signals are transmitted by means of radio not only to the spatially closest of the control devices, but that they also retransmitted to the others via cable in a refreshed form with the required strength. The common computer capacity will enable a reliable inspection of the longwall support units that are to be addressed respectively.

When one of the central control systems 50, 51, or the hand-operated device 37 (FIG. 2) inputs a control command into the system, the control command will be transmitted via the respectively free bus line 58 or 59. In this process, the control commands are transmitted in the described manner through the individual mining shield control devices 34.1, 34.2 . . . Only that mining shield control device will be addressed, whose stored code word corresponds to the code word that is assigned to the control signal. The receipt and/or the execution of the corresponding control command can be acknowledged by a feedback signal, since one of the two bus lines 58 or 59 as well as the radio communication are available for this purpose. The feedback can occur immediately and without time delay, so that also an immediate check is possible on the input device, i.e., primary central control system 50, secondary central control system 51, or control device 37. The corresponding control signals are retransmitted to the valve control device 40 (FIG. 1), whereby the control magnet 47 of the pilot valve 45 is activated, and the respective main valve 44 of the biasing means 30 is actuated. It is now also possible to return, via the bus lines, the signals of the pressure sensors, which are arranged for controlling and monitoring on each of the biasing means and/or valves.

Many modifications and other embodiments of the invention set forth herein will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. A longwall support control for controlling the movements of a plurality of longwall support units in the longwall of a mine, comprising:

a central control system, and a separate mining shield control device locally and operationally associated to each longwall support unit, the mining shield control devices being connected via radio to a portable decentralized operating device for inputting control commands and for feeding back inspection data, wherein each mining shield control device comprises a multi-channel radio transceiver, such that the mining shield control device is in a simultaneous transmit and receive mode with the decentralized operating device for receiving control signals and for transmitting inspection data, and wherein the mining shield control device is programmed in such a manner that control signals that are received via radio, can be converted into functions of the longwall support unit when the control signal stores a code word that is associated with the called up mining shield control device, and wherein the mining shield control devices are interconnected and also connected to the central control system via at least one bus line for transferring input data to all mining shield control devices, and wherein a mining shield control device closest to the decentralized operating device receives the strongest radio signal from the decentralized operating device and is able to retransmit the received signal via the at least one bus line to the other mining shield control devices, while also permitting direct back and forth radio contact between the operating device and a selected mining shield control device.

2. The longwall support control of claim 1, wherein the mining shield control devices are interconnected and also connected to the central control system by a parallel bus line, whereby command signals and control signals can be transmitted simultaneously.

3. The longwall support control of claim 1, wherein each mining shield control device comprises an amplifier for the control signals that do not include a code word assigned to the respectively called up mining shield control device and which are received via the at least one bus line.

4. The longwall support control of claim 1, wherein each mining shield control device comprises a switching element which permits the separation of the at least one bus line, the switching element being normally closed so as to allow signals to pass and being opened to effect a separation of the one bus line upon the occurrence of a failure.

5. The longwall support control of claim 1, wherein said decentralized operating device comprises a portable hand-operated device.

* * * * *